United States Patent [19]

Gueret

[11] Patent Number: 4,993,440

[45] Date of Patent: Feb. 19, 1991

[54] BRUSH FOR THE APPLICATION OF COSMETIC PRODUCTS, MASCARA IN PARTICULAR

[75] Inventor: Jean-Louis Gueret, Paris, France

[73] Assignee: L'Oreal, Paris, France

[21] Appl. No.: 386,037

[22] Filed: Jul. 27, 1989

Related U.S. Application Data

[63] Continuation of Ser. No. 125,096, Nov. 25, 1987, abandoned.

[30] Foreign Application Priority Data

Nov. 28, 1986 [FR] France ..... 86 16625

[51] Int. Cl.[5] ..... A45D 40/26

[52] U.S. Cl. ..... 132/218; 132/320; 15/159 A; 15/206; 401/118; 401/129

[58] Field of Search ..... 132/218, 320; 15/159 A, 15/206; 401/129, 268, 118

[56] References Cited

U.S. PATENT DOCUMENTS

| | | | |
|---|---|---|---|
| 2,433,325 | 12/1947 | Slaughter | 15/159 A |
| 2,508,799 | 5/1950 | Reis, Jr. | 15/159 A |
| 3,214,782 | 11/1965 | Masters et al. | 401/129 |
| 3,238,553 | 3/1966 | Bailey et al. | 15/159 A |
| 3,344,457 | 10/1967 | Grobert . | |
| 4,381,325 | 4/1983 | Masuda et al. | 15/159 A |
| 4,733,425 | 3/1988 | Hartel et al. | 132/218 |

FOREIGN PATENT DOCUMENTS

| | | | |
|---|---|---|---|
| 1140901 | 12/1962 | Fed. Rep. of Germany . | |
| 685054 | 12/1952 | United Kingdom | 401/129 |
| 2170996 | 8/1986 | United Kingdom . | |

*Primary Examiner*—Kenneth J. Dorner
*Assistant Examiner*—J. Hakomaki
*Attorney, Agent, or Firm*—Cushman, Darby & Cushman

[57] ABSTRACT

This brush is constituted in the conventional manner by an elongate central core around which there are implanted substantially radially disposed bristles (3) which are regularly distributed. According to the invention, the bristles (3) have at their surface at least partly, preferably all, at least one capillary channel (8) which is advantageously rectilinear, extending substantially from their base as far as their tip. In particular, a cruciform cross section is chosen, as represented below. The capillary channels constitute regularly disposed locations for mascara reserves and allowing on application a fast and efficient transfer of the mascara to the eyelashes with a view to a homogeneous make up.

8 Claims, 1 Drawing Sheet

BRUSH FOR THE APPLICATION OF COSMETIC PRODUCTS, MASCARA IN PARTICULAR

This is continuation-in-part of Application No. 07/125,096, filed Nov. 25, 1987, now abandoned.

The present invention concerns a brush for the application of cosmetic products, more particularly intended for the making up of the eyelashes by means of a lash reinforcing product, also called mascara. However, as another possible application, brushes could be mentioned which are intended for the application of dye to the hair.

The usual brushes of this type comprise most frequently tufts of relatively long bristles disposed in rings or spirals around a core or a support constituted by a twisted iron wire. Moreover, the bristles have a circular cross section.

Since one is in particular concerned with mascara brushes, these have the drawback of procuring a poor distribution of the makeup product on the eyelashes which in practice is found to be positioned in blobs without any homogeneity, which makes obtaining a suitable coating of the eyelashes by the makeup product a difficult and lengthy affair.

This drawback is in particular due to a defect in the distribution of the makeup product taken up on the brush at the outlet of the mascara reservoir.

It is in fact known that a conventional mascara applicator comprises a mascara reservoir and a detachable cap which is intended to close the reservoir and which constitutes a handle allowing a brush carried by the end of a stem which is integral with the cap to be manipulated. In the closed position of the reservoir, the stem and the brush associated therewith penetrate into the reservoir. When the stem is withdrawn from the reservoir, a certain quantity of mascara is taken up on the brush which can then be applied on the lashes. Moreover the brush generally penetrates into the reservoir through a substantially circular opening surrounded by a flexible lip whose function is to exert a wiping action on the bristles of the brush with the object of eliminating the excess make up product taken up by the brush inside the reservoir. The diameter of this circular opening is smaller than the minimum diameter of the brush measured at the tip of the bristles, so that the flexible lip surrounding the opening can exert its action of wiping the brush when the latter is being extracted from the reservoir.

However, it is this obligatory wiping action which leads to an uneven disposition of the mascara product on the bristles. In fact, if these latter are relatively dense and supple (having a relatively small diameter), as is the case with conventional brushes, they lie down from one arrray or one turn on the other when passing through the wiper lip and have tendency to produce an accumulation of the make up product in the region situated around the core, so much so that one cannot obtain with a single pass of the brush, an even and homogeneous coating of the lashes by the make up product, since the latter will have to pass progressively towards the ends of the bristles which initially carry only a small charge of the product. Moreover this passing is effected in a haphazard manner.

If the bristles are sparser and harder (with a relatively larger diameter) which constitutes a recent mode of embodiment procuring worthwhile advantages in the sphere of make up properly so called, the wiping action does not lead to charging the brush around the core only; in other words, the drawback of the conventional brushes seems at first sight to have been overcome, because at the time of passing through the wiper lip, the bristles of one array or one turn penetrate between those of the following array or turn and then return individually into their rest position, charged in principle from their base to their tip with the make up product; it has, however, been observed that the product could not always be disposed in a perfectly even and homogeneous manner on the bristles; this, therefore leads to the same inconvenience as before, especially since it is also necessary that an enven transfer of the product on to the eyelashes should be ensured during the application.

The present invention allows this drawback to be remedied. For this purpose, it is proposed in accordance with the invention that at least a portion of the bristles of the brush, but preferably all, should each comprise at least one capillary channel extending over the whole length of the bristle. In these conditions, the make up product to be applied is disposed evenly and homogeneously in these capillary channels which thus constitute a reserve from which the make up product can be distributed, flowing uniformly over the lashes; it follows therefrom that one can obtain an even and homogeneous application of the product on the eyelashes in practically one single pass.

Bristles having such an overall structure are already known for equipping industrial brushes, where the capillary channels are intended to ensure better brushing, as well as for equipping shaving brushes, where the capillary channels procure a better foaming effect of the shaving cream. Neither in one case, nor the other is it the intention to ensure the even charging of a cosmetic product on to a brush with the object of subsequently ensuring a fast and correct distribution on such a particular base as the eyelashes.

The object of the present invention is therefore a new industrial product constituted by a brush for the application of cosmetic products, in particular for the application of mascara to the eyelashes, or of a dye to the hair, constituted by a central elongate core around which there are implanted bristles disposed substantially radially and being regularly distributed, characterised in that each bristle of at least one portion of the brush comprises on its surface at least one capillary channel extending substantially from its base as far as its tip. Preferably all the bristles of the brush have capillary channels, which makes it possible to obtain the best effect of an even charging of the brush, with a view to a homogeneous distribution on the eyelashes.

In accordance with a preferred mode of embodiment of the present invention, the median line of a capillary channel formed on the surface of a bristle is a straight line parallel to the axis of the said bristle.

In the case where the brush comprises bristles each provided with at least two capillary channels, the latter are advantageously regularly disposed at the periphery of the bristle considered.

The number of capillary channels possessed by one bristle can be as musch as five and it can in particular be four, the corresponding bristle having in that case a cruciform cross section.

Moreover, each capillary channel advantageously has a generally V shaped or U shaped cross section, whose sides can move slightly towards each other near their free ends, before again diverging from each other in the zone where the capillary channel opens out at the surface of the bristle, so that the make up product can be better retained at the bottom of the channels at the time when the mascara is taken up.

Moreover, in accordance with a particular characteristic of the brush according to the invention, each bristle is inscribed as a whole in a cylinder with a diameter comprised between 0.06 and 0.25 millimeters, a capillary channel having a depth comprised between 0.01 and 0.06 millimeters and a larger width comprised between 0.01 and 0.06 millimeters.

The bristles of the brush according to the invention are advantageously made by the extrusion of a plastic material, such as Nylon-6.6 or Nylon-6.10 and in particular Nylon-6.6, the latter having the property of absorbing much more of the atmospheric humidity than Nylon-6.10 and, therefore, of softening with time. The choice of Nylon-6.6 is, therefore, worthwhile when one wishes to modify the hardness of the bristle, so that, in use one ends up with obtaining a softer bristle.

To constitute brushes comprising sparse and relatively hardbristles with a diameter of the order of 0.17 millimeters, use can advantageously be made of bristles with a cruciform cross section made from the fibers marketed by the "RHONE-POULENC" Company under the designation of "NAX" made of Nylon-6.10, or preferably of Nylon-6.6 for the same reasons as indicated above, or yet again from Nylon-6.10 fibres marketed by the "DU PONT DE NEMOURS" COMPANY under the designation of "TYNEX".

In accordance with a particular mode of embodiment of the the present invention, the core of the brush is formed by bending a metallic wire back on itself, then by twisting the wire thus doubled so as to block a helical array of radial bristles around the core, the resultant brush being inscribed as a whole in a cylinder with its axis identical with that of the core, or in a elongate cone frustum tapering towards its free end, with its axis identical with that of the core.

To render the object of the the present invention more readily understood, serveral modes of embodiment will be described below with reference to the attached drawings purely by way of a non restrictive indication.

In these drawings

Figure 1:
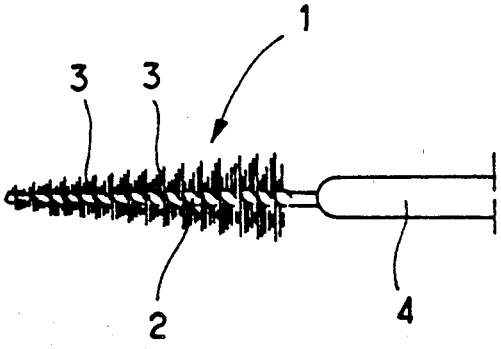
FIG. 1 is a view in profile of a mascara brush of a generally conventional aspect, this representation, since it is substantially made at full scale, does not make it possible to distinguish the characteristics of the present invention which concern solely the bristles of this brush.

If reference is now made to FIG. 1, it will be seen that a make up brush for the eyelashes has been designated by 1 as a whole. This brush 1 is constituted by a central core 2 at the periphery whereof there are implanted the bristles 3, the core 2 being constituted in the conventional manner by a twisted iron wire holding a helical array of radial bristles 3. The core 2 is joined to the stem 4 of a conventional applicator device.

The brush 1 is inscribed as a whole in a cone frustum tapering towards its free end.

Figure 2:
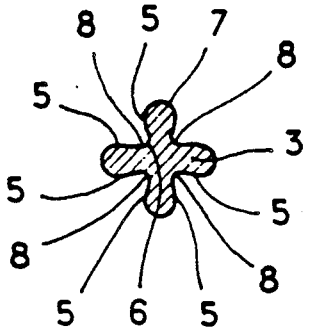
FIG. 2 represents on a greatly enlarged scale a cross section of a bristle of a brush conforming to a prefererred mode of embodiment of the present invention.

The bristles 3 have the special feature of being cruciform in cross seciton, as shown in FIG. 2.

A bristle 3 has an external cylindrical shell with a diameter of the order of 0.08 millimeters, the resultant brush 1 being a conventional brush having relatively dense arrays of flexible bristles, such flexibility being obtained by the combined choice of the diameter of the bristles and of the plastic material used to constitute the latter. At the surface of each of bristles 3, there are cut with a regular distribution four identical longitudinal channels 8 with their axes parallel to that of the said bristle 3.

Each channel 8 has a V shaped cross section, whose facing sides form an angle which is of the order of 90°, but which does not exceed 90°. The sides 5 are joined along a rounded furrow bottom 6. Moreover, near their free edges, the sides 5 have a slight bead or swelling 7 before opening out to the outside of the bristle 3.

The depth of the channels 8, measured along a diameter of the bristle 3, is of the order of 0.01 to 0.06 millimeters.

Thus there are constituted along each bristle four reserves of the make up product which is trapped by capillarity when the mascara is taken out of the reservoir.

In this way, the brush 1 is evenly charged with the make up product from the base of the bristles 3 as far as their tip and at the time of application, the reserves are progressively emptied, leading to a fast and homogeneous coating of the make up product on the eyelashes.

Figure 3:
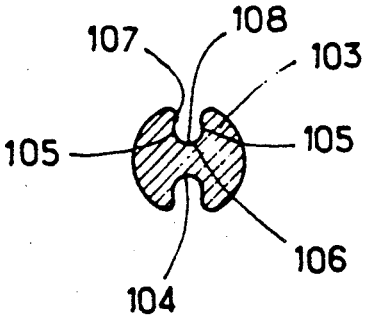
FIGS. 3 and 4 are views similar to FIG. 2, showing variants of the embodiment of the brush bristles.
Figure 4:
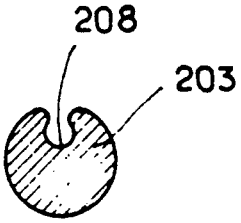

FIGS. 3 and 4 each represent a variant of the embodiment of the bristle 3. In accordance with the first variant, the bristle 103 (FIG. 3) comprises two capillary channels 108 instead of four. The overall cross section of the bristle 103 is also circular and the two channels 108 are cut on opposite sides to each other along the same diameter. Each channel 108 has a U shaped cross section, whose facing sides 105 are joined to the bottom 106 by rounded zones. Moreover, in the same way as in the mode of embodiment of FIG. 2, the sides 105 have near their free edges a bead 107, just before opening out towards the outside of the bristle 103. The depth of one furrow 106, measured along the diameter of the cross section, is of the order of 0.01 to 0.06 millimeters. As for its larges width, measured between two facing sides 105, it is 0.06 millimeters.

The bristles 103 constitute reserves for the make up product of a smaller volume for a given bristle than the bristles 3 according to FIG. 2. However, it is apparent that the bristles of the type of the bristles 103 procure acceptable results, especially if the dimensions of the brush, the distribution of the bristles, their hardness, their dimensions and the material constituting them are chosen accordingly.

The same applies as regards the bristle 203 of FIG. 4 which comprises only a single capillary longitudinal channel 208 instead of two. Here too, one will choose such a bristle type according to the result looked for and the other characteristics of the bristles forming the brush.

It shall be duly understood that the modes of embodiment described above are in no way restrictive and may give rise to any desirable modification without thereby departing from the scope of the present invention.

I claim:

1. A brush for the application of a cosmetic product which is contained in a device including a wiping system, in particular, for the application of mascara to the eyelashes or of a dye to the hair, said brush having a central elongate core, around which are carried bristles disposed to extend substantially radially from said core and being regularly distributed, at least some of said bristles having at least one portion on its surface formed as a capillary channel which extends substantially from the base of the bristle as far as the tip of the bristle, each capillary channel having a generally V or U shaped form in cross-section, the sides of the U or V which constitute the shape of one capillary channel soming, in cross-section slightly nearer to each other near their free ends before again diverging in the zone where the capillary channel opens out at the surface of the bristle, each bristle being inscribed as a whole in a cylinder with a diameter between about 0.06 and 0.25 mm, a capillary channel having a depth between about 0.01 and 0.06 mm and a greater width of between about 0.01 and 0.06 mm, whereby, after the brush is wiped by the wiping system of the device there is an even distribution of the cosmetic product over the entire length of each of said bristles.

2. A brush according to claim 1, characterised in that all the bristles (3; 103; 203) have capillary channels (8; 108; 208).

3. A brush according to claims 1 or 2, characterised in that the median line of a capillary channel (8; 108; 208) formed on the surface of a bristle (3; 103; 203) is a straight line parallel to the axis of the said bristle (3; 103; 203).

4. A brush according to claim 1, comprising bristles (3; 103) each provided with at least two capillary channels (8; 108), characterised in that the said capillary channels (8; 108) are regularly distributed at the periphery of the bristle (3; 103) considered.

5. A brush according to claim 1, characterised in that the number of capillary channels (8; 108; 208) possessed by one bristle (3; 103; 203) is at most equal to five.

6. A brush according to claim 5, characterised in that one bristle (3) carries four capillary channels (8), the cross section of the said bristle being cruciform.

7. A brush according to claim 1, characterised in that these bristles (3; 103; 203) are made by the extrusion of a plastic material, such as Nylon-6.6 or Nylon-6.10.

8. A brush according to claim 1, characterised in that the core (2) is formed by folding a metallic wire back on itself, then by twisting this wire thus doubled, so as to block a helical array of radial bristles (3) around the core (2), the resultant brush (1) being inscribed as a whole in a cylinder with its axis identical with that of the core (2), or in an elongate cone frustum tapering towards its free end, with its axis identical with that of the core (2).

* * * * *